US005088430A

United States Patent [19]

Hansberry

[11] Patent Number: 5,088,430

[45] Date of Patent: Feb. 18, 1992

[54] LIMP MATERIAL SEGMENT COUPLER FOR A SEWING MACHINE TO TRANSPORT FABRIC WORKPIECES

[75] Inventor: Mitchell L. Hansberry, Framingham, Mass.

[73] Assignee: The Charles Stark Draper Laboratory, Inc., Cambridge, Mass.

[21] Appl. No.: 523,726

[22] Filed: May 15, 1990

[51] Int. Cl.[5] ..... D05B 27/00

[52] U.S. Cl. ..... 112/320; 112/121.12; 271/264

[58] Field of Search ..... 112/311, 320, 121.12, 112/121.15, 2, 1, 235; 901/30, 41; 271/18, 18.3, 264, 266, 267

[56] References Cited

U.S. PATENT DOCUMENTS

| | | | |
|---|---|---|---|
| 4,195,581 | 4/1980 | Ohara | 112/121.12 X |
| 4,457,243 | 7/1984 | Bowditch | 112/121.14 |
| 4,512,269 | 4/1985 | Bowditch | 112/121.12 |
| 4,607,584 | 8/1986 | Bowditch | 112/147 |
| 4,632,046 | 12/1986 | Barrett et al. | 112/121.14 |
| 4,688,499 | 8/1987 | Moore et al. | 112/121.12 |
| 4,719,864 | 1/1988 | Barrett et al. | 112/121.12 |
| 4,763,587 | 8/1988 | Frye | 112/121.12 |
| 4,932,343 | 6/1990 | Mardix et al. | 112/121.12 |

*Primary Examiner*—Peter Nerbun
*Attorney, Agent, or Firm*—Lahive & Cockfield

[57] ABSTRACT

The invention is an improved limp material segment coupling assembly. The segment coupling assembly includes a rigid drive member and a segment coupler having a substantially planar lower surface. The lower surface is adapted to frictionally engage a limp material segment. A spring coupler couples the segment coupler to the drive member. The spring coupler includes at least one bent sheet spring. Each bent sheet spring includes a resilient sheet extending between the drive member and the segment coupler. The spring axes of each of the springs are substantially parallel to the planar surface of the segment coupler.

7 Claims, 3 Drawing Sheets

LIMP MATERIAL SEGMENT COUPLER FOR A SEWING MACHINE TO TRANSPORT FABRIC WORKPIECES

REFERENCE TO RELATED APPLICATION

The subject matter of this application is related to the subject matter of U.S. Patent application Ser. No. 07/523,666, entitled "Limp Material Segment Transport Apparatus" filed even date herewith.

BACKGROUND OF THE INVENTION

This invention relates to the transportation of limp material segments, such as fabric. In particular, the invention relates to an apparatus for frictionally engaging limp material segments for transportation along a work surface.

Conventional techniques for transporting limp material segments along a work surface to a workstation often utilize manual labor. In the context of the textile industry, garment assembly personnel may manually feed the fabric workpiece or workpieces along a work surface to the sewing head of a sewing machine. Although many aspects of the textile industry benefit from automation, in practice transportation of fabric workpieces for assembly at a sewing machine largely remains dependent upon manual labor.

A primary shortcoming of the use of manually controlled workpiece transport is that the technique is enormously labor intensive; that is to say, a large portion of the cost to manufacture a product from limp material is attributable to labor. To reduce cost, techniques focusing on automation of transporting a limp material segment is desirable.

There are several known techniques for precisely controlling the position of the workpiece in the near-field region of the sewing head, see, for example, U.S. Pat. No. 4,719,864. Feed dog assemblies have also been used for this function. Those controllers however are generally so limited in their range of operation that other techniques are required to feed the workpiece to the effective range of the near-field controllers.

There are also known techniques for automatically (e.g. under the control of a programmed computer) driving endless belts to transport limp material workpieces over relatively large distances to workstations, see, for example, U.S. Pat. Nos. 4,457,243, 4,512,269, 4,032,046 and 4,607,584.

However, the endless belt techniques, which are particularly effective for control of gross motion control of workpieces are limited in their applicability to relatively short range motions necessary, for example, to present fabric to the near-field controller of an automated sewing machine. Therefore, there exists a need for improved systems for controlling the transport of limp material segments, particularly for application where linear feed control is needed to drive a workpiece to a position within the range of a near-field controller for a seam joining assembly.

SUMMARY OF THE INVENTION

The present invention is an apparatus for frictionally engaging limp material segments, for example cloth, for transportation along a substantially planar work surface.

In one embodiment of the invention, the limp material segment coupling apparatus includes a segment coupler having a substantially planar surface and capable of frictionally engaging a limp material segment, and a spring coupler for coupling the segment coupler to the drive member. The spring coupler includes at least one bent sheet spring which includes a resilient sheet extending from a first end to a second end along at least one spring axis and being bent along at least one axis perpendicular to the associated spring axis wherein each of the springs is coupled at the inner end to the drive member and at the outer end to the segment coupler. The spring axes of each of the springs are substantially parallel to the planar surface of the segment coupler.

In another embodiment of the invention, the spring coupler includes at least three bent sheet springs which includes a resilient sheet extending from a first end to a second end along at least one spring axis and being bent along at least one axis perpendicular to the associated spring axis wherein each of the springs is coupled at the inner end to the drive member and at the outer end to the segment coupler. The spring axes of each of each of the springs are substantially parallel to the planar surface of the segment coupler.

In yet another form of the invention, the spring coupler includes a pair of bent sheets spring which include a resilient sheet extending from a first end to a second end along a spring axis and being bent along an axis perpendicular to the associated spring axis wherein each of the springs is coupled at one end to the drive member and at the other end to the segment coupler with the spring axes of each of the springs of the first pair being substantially parallel. In addition, the spring coupler includes a second pair of bent sheet springs which similarly include a resilient sheet extending from a first end to a second end along a spring axis and being bent along an axis perpendicular to the associated spring axis wherein each of the springs is coupled at one end to the drive member and at the other end to the segment coupler with the spring axes of each of the springs of the second pair being substantially parallel. The spring axes of the first pair are substantially perpendicular to the springs of the second pair and are substantially parallel to the planar surface of the segment coupler.

In another form of the invention the spring coupler is comprised of a first single resilient sheet, extending along a first spring axis, coupled at a first distal end to the segment coupler, at an intermediate point to the rigid drive member, and at a second distal end to the segment coupler. In addition, the spring coupler further includes a second single resilient sheet, extending along a second spring axis, coupled at a first distal end to the segment coupler, at an intermediate point to the rigid drive member, and at a second distal end to the segment coupler. The first and second spring axes are substantially perpendicular.

In another form of the invention the spring coupler is comprised of a single annular bent spring which includes an annular resilient sheet extending radially from an inner end to an outer end along radially extending spring axes and is bent along axes perpendicular to said spring axes. The single annular bent spring is coupled at said inner end to said drive member and at said outer end to said segment coupler.

BRIEF DESCRIPTION OF THE DRAWINGS

The foregoing and other objects of this invention, the various features thereof, as well as the invention itself, may be more fully understood from the following description, when read together with the accompanying drawings in which.

DESCRIPTION OF THE PREFERRED EMBODIMENT

Figure 1:
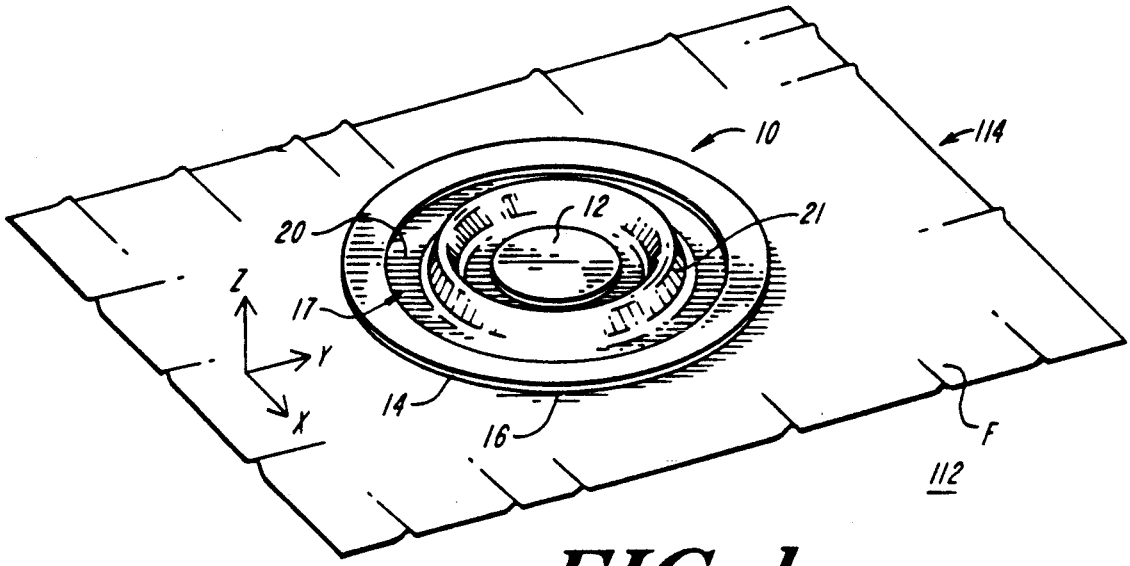
FIG. 1 illustrates in a perspective view an exemplary embodiment of the segment coupling apparatus in accordance with the present invention.

FIG. 1 shows an exemplary limp material segment coupling apparatus 10 in accordance with the present invention. Apparatus 10 is shown over a limp fabric workpiece F on the planar top surface 114 of work platform 112. Apparatus 10 includes a rigid drive member 12, an annular segment coupler 14 having a substantially planar lower surface 16 which is adapted to frictionally engage a limp material segment, and a spring coupling assembly 17. The segment coupler may be, e.g., a fabric workpiece transportation element of a sewing machine. With this configuration, the drive element 12 is adapted to be selectively positioned by an external driver (not shown), so that the workpiece F is moved with respect to top surface 114 substantially as the drive element is moved.

In the embodiment of FIG. 1, spring coupling assembly 17 is comprised of a sheet spring 20 which is an annular resilient sheet extending from its inner peripheral edge to its outer peripheral edge. Sheet spring 20 is coupled at its inner edge to drive member 12 and at its outer edge to segment coupler 14. The sheet spring 20 has an annular region 21 which is bent about a closed circular axis. For this annular sheet spring embodiment, spring axes are considered to extend radially outward from the center of the drive member 12. The spring axes are substantially parallel to Planar lower surface 16 of segment coupler 14.

In operation, limp material segment coupling apparatus 10 substantially resists rotational and/or undesired lateral motion when engaged with and during the transportation of a limp material segment along work platform 112. Apparatus 10 is utilized to frictionally couple a limp material workpiece F and in response to an applied force to drive member 12 to traverse a path substantially coherent with the direction of the horizontal component of the applied force.

In particular, limp material segment coupling apparatus 10 is configured such that it is substantially resistant to torsional and/or lateral motion in the X-Y plane. That is to say, when a force is applied to drive member 12, wherein the applied force has both vertical and horizontal components, apparatus 10 is resistant to torsional motion with respect to both the direction of the horizontal component of the applied force and the substantially planar surface 114 of work platform 112. However, apparatus 10, in response to the applied force traverses a substantially coherent path with respect to the direction of the horizontal component of the applied force. Coupler 14 of apparatus 10 is relatively vertically compliant to accommodate for variability in thickness (such as caused by cross-seams) in the limp material F. Moreover, coupler 14 is substantially resistant to linear or rotational motion (relative to drive member 12).

Figure 2:
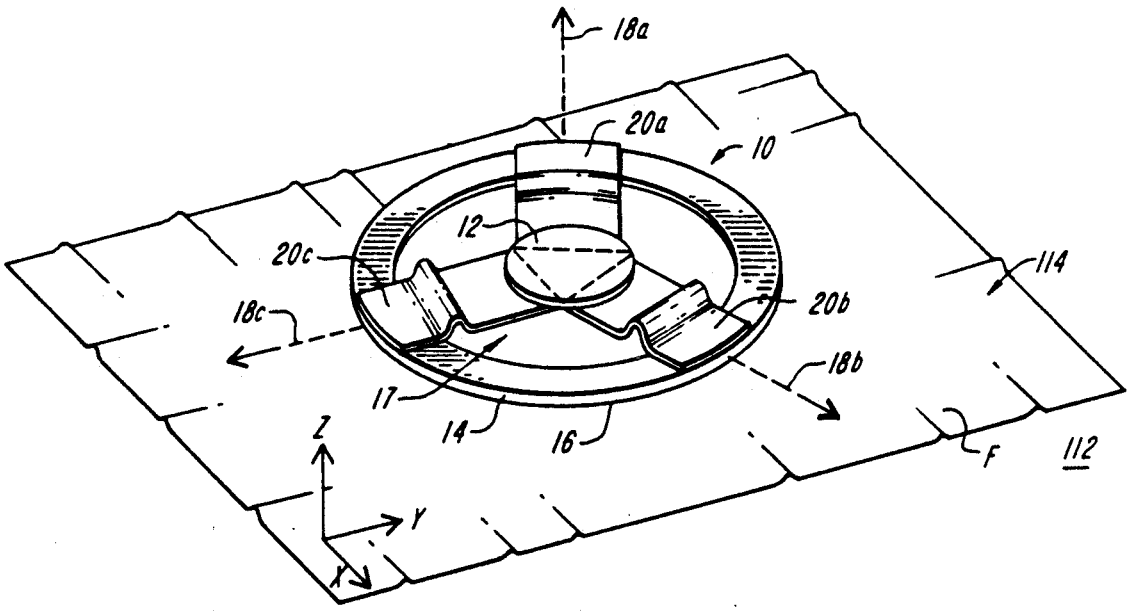
FIG. 2 illustrates in a perspective view another embodiment of the segment coupling apparatus in accordance present invention.

FIG. 2 shows an embodiment of the spring coupling assembly 17 of a limp material segment coupling apparatus 10 in accordance with the present invention. In the illustrative embodiment, spring coupling assembly 17 includes three bent sheet springs **20*a*, 20*b* and 20*c***.

Sheet springs **20*a*, 20*b* and 20*c* are each comprised of a resilient sheet extending from a first end to a second end along spring axes 18*a*, 18*b* and 18*c*, respectively. Sheet springs 20*a*, 20*b* and 20*c* are each coupled at the inner end to drive member 12 and at the outer end to segment coupler 14, wherein the sheet springs are bent along axes perpendicular to spring axes 18*a*, 18*b* and 18*c*, respectively. Spring axes 18*a*, 18*b* and 18*c* are substantially parallel to planar surface 16 of segment coupler 14, and in addition are in an equi-angular configuration about drive member 12**, although differing angular dispersions may be used.

Figure 3:
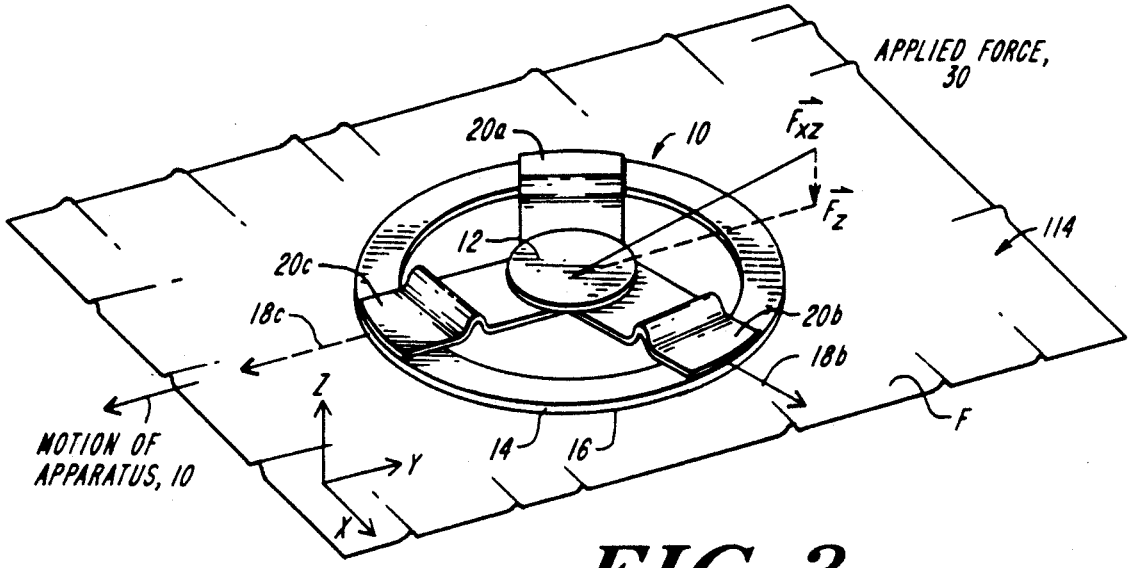
FIG. 3 illustrates in a perspective view the segment coupling apparatus of FIG. 2 under an applied force.

FIG. 3 illustrates the reaction and motion of the apparatus 10 of FIG. 2 due to an applied force $F_{xz}$ denoted by force vector 30. As described above, sheet springs **20*a*, 20*b*, and 20*c* are configured to resist the torsional motion and/or the undesired lateral movement resulting from applied force 30. Segment coupler 14 traverses a path substantially coherent with respect to the direction of the horizontal component of applied force 30. In the illustrated embodiment, applied force 30 includes a vertical component ($F_z$) and a horizontal component ($F_x$). In response to applied force 30, limp material coupling apparatus 10 traverses a direction substantially coherent with the direction of horizontal component ($F_x$). Note, when segment coupling assembly 10 is engaged with a limp material segment, sheet springs 20*a*, 20*b*, and 20*c* permit segment coupler 14 to tilt with respect to the planar work platform 112**.

Figure 4:
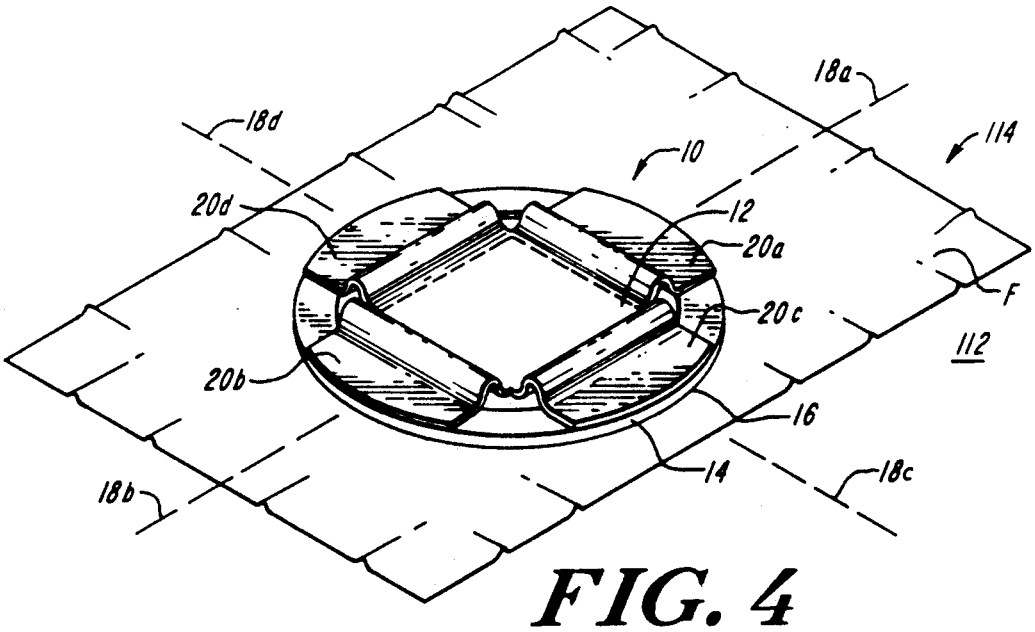
FIG. 4 illustrates in a perspective view another embodiment of the segment coupling apparatus in accordance present invention.

FIG. 4 shows the spring coupling assembly 17 for an alternative embodiment of a limp material segment coupling apparatus 10 in accordance with the present invention. In the illustrative embodiment, spring coupling assembly 17 includes four bent sheet springs **20*a*, 20*b*, 20*c* and 20*d* extending from an integral central region. A first pair of sheet springs 20*a* and 20*b* are comprised of a resilient sheet extending along spring axes 18*a* and 18*b*, respectively. A second pair of sheet springs 20*c* and 20*d* are also comprised of a resilient sheet extending along spring axes 18*c* and 18*d***, respectively.

As in the previously described embodiment, sheet springs **20*a*, 20*b*, 20*c* and 20*d* are coupled at the inner end at the central region to drive member 12 and at the outer end to segment coupler 14 wherein the sheet springs are bent along an axis perpendicular to spring axes 18*a*, 18*b*, 18*c* and 18*d*, respectively Spring axes 18*a*, 18*b*, 18*c* and 18*d* are substantially parallel to planar surface 16 of segment coupler 14. In addition, spring axes 18*a* and 18*b* of first pair of sheet springs (20*a* and 20*b*) are substantially perpendicular to spring axes 18*c* and 18*d* of the second pair of sheet springs (20*c* and 20*d*); and, sheet springs 20*a*, 20*b*, 20*c* and 20*d* are in an equi-angular configuration about drive member 12**.

Figure 5:
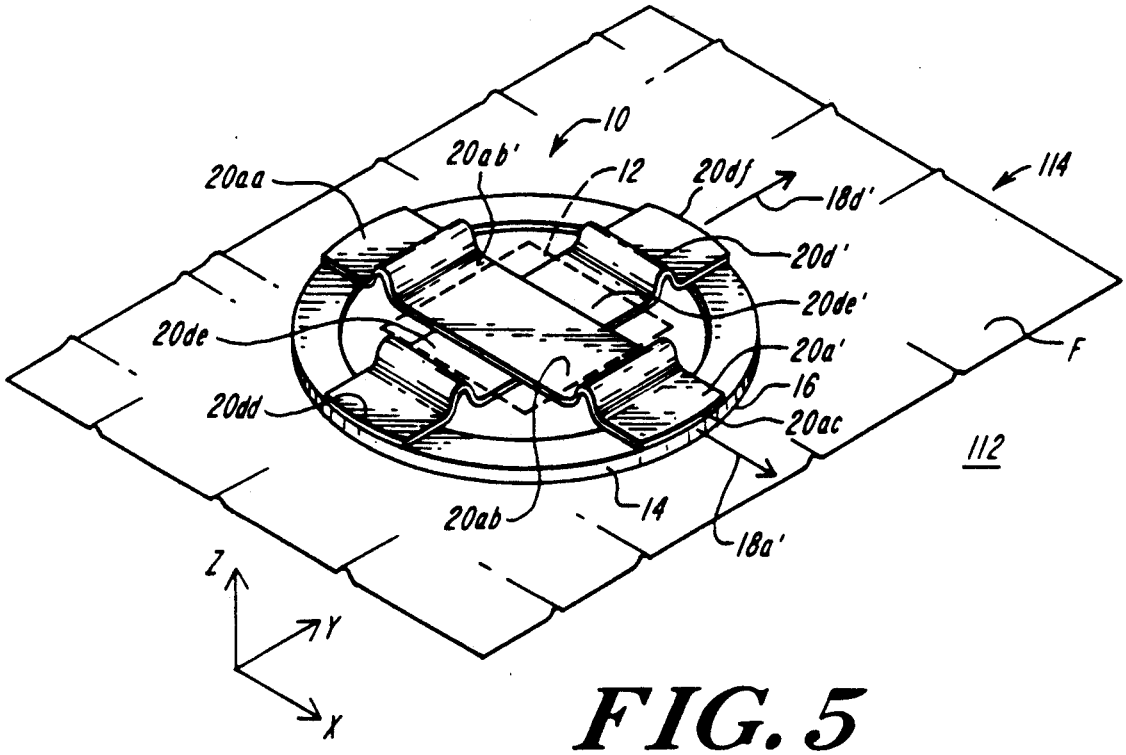
FIG. 5 illustrates in a perspective view another embodiment of the segment coupling apparatus of FIG. 4.

Illustrated in FIG. 5 is an alternative form of the embodiment illustrated in FIG. 3, specifically an alternate form of the spring coupling assembly 17. Sheet springs **20*a* and 20*b* may be comprised of a single resilient sheet 20*a*', extending along a single spring axis 18*a*', coupled at first distal end 20*aa* to segment coupler 14, at intermediate point 20*ab* and 20*ab*'** to rigid drive member 12, and at second distal end 20*ac* to segment coupler 14. Similarly, sheet spring 20*c* and 20*d* may be comprised of a single resilient sheet 20*d'*, extending along a single spring axis 18*d'*, coupled at first distal end 20*dd* to segment coupler 14, at an intermediate point 20*de* and 20*de'* to rigid drive member 12, and at second distal end 20*df* to segment coupler 14. In addition, spring axes 18*a'* and 18*d'* are substantially perpendicular.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. Apparatus for resiliently biasing a material segment against a substantially planar work surface, comprising:

A. a rigid drive member;

B. a segment coupler including a substantially planar surface, said surface having means for frictionally engaging said material segment;

C. spring coupling means for coupling said segment coupler to said drive member, said spring coupling means including:

at least one bent sheet spring extending at least partially within the boundary of said segment coupler, each said spring including a resilient sheet extending from an inner end to an outer end along at least one spring axis and being bent along an axis perpendicular to said spring axis, and each said spring being coupled at an inner end to said drive member and at said outer end to said segment coupler with each spring axis being substantially parallel to said planar surface of said segment coupler.

2. Apparatus according to claim 1 including a plurality of bent spring sheets extending along a plurality of spring axes, wherein said spring axes are substantially equi-angularly dispersed about said drive member.

3. Apparatus according to claims 1 or 2 wherein said spring coupling means comprises:

i. a first bent sheet spring, said first sheet spring including a resilient sheet extending along a first spring axis and being bent along axes perpendicular to said spring axis, and being coupled at a first distal end to said segment coupler, at an intermediate point to said rigid drive member, and at a second distal end to said segment coupler, and ii. a second bent sheet spring, said second sheet spring including a resilient sheet extending along a second spring axis and being bent along axes perpendicular to said second spring axis, and being coupled at a first distal end to said segment coupler, at an intermediate point to said rigid drive member, and at a second distal end to said segment coupler, wherein said first spring axis of said first sheet spring is substantially perpendicular to said second spring axis of said second sheet spring and each axis is substantially parallel to said planar surface of said segment coupler.

4. Apparatus according to claims 1 or 2 wherein said spring coupling means comprises:

three bent sheet springs, each of said springs including a resilient sheet extending from an inner end to an outer end along a spring axis and being bent along an axis perpendicular to said spring axis, and each of said springs being coupled at said inner end to said drive member and at said outer end to said segment coupler, wherein said spring axes are substantially equi-angularly dispersed about said drive member.

5. Apparatus according to claims 1 or 2 wherein said spring coupling means comprises:

i. a first pair of bent sheet springs, each of said springs of said first pair including a resilient sheet extending from a first end to a second end along a first spring axis and being bent along an axis perpendicular to said first spring axis, and each of said springs of said first pair being coupled at one end to said drive member and at the other end to said segment coupler with the spring axes of each of said springs of said first pair being substantially parallel, and ii. a second pair of bent sheet springs, each of said springs of said second pair including a resilient sheet extending from a first end to a second end along a second spring axis and being bent along an axis perpendicular to said second spring axis, and each of said springs of said second pair being coupled at said inner end to said drive member and at said outer end to said segment coupler with the spring axes of each of said springs of said second pair being substantially parallel, wherein said spring axes of said first pair are substantially perpendicular to the spring axes of said second pair and are substantially parallel to said planar surface of said segment coupler.

6. Apparatus according to claim 1 wherein said spring coupling means comprises:

a single annular bent spring, said spring including an annular resilient sheet extending radially from an inner end to an outer end along radially extending spring axes and being bent along axes perpendicular to said spring axes, said spring being coupled at said inner end to said drive member and at said outer end to said segment coupler.

7. Apparatus according to claim 1 wherein said segment coupler is a sewing machine fabric workpiece transportation element.

* * * * *